United States Patent [19]

Narushko

[11] Patent Number: 4,579,245

[45] Date of Patent: Apr. 1, 1986

[54] DISPOSABLE LEAKPROOF CONTAINER LIDS

[76] Inventor: Suzanne B. Narushko, 6141 Colgate Ct., Sacramento, Calif. 95831

[21] Appl. No.: 743,004

[22] Filed: Jun. 10, 1985

[51] Int. Cl.[4] ..... B65D 51/18

[52] U.S. Cl. ..... 220/253; 220/254; 220/345; 220/346; 222/561

[58] Field of Search ..... 220/90.4, 253, 254, 220/345, 346; 222/559, 560, 561, 480

[56] References Cited

U.S. PATENT DOCUMENTS 3,332,586 7/1967 Amburgey ..... 220/345
4,127,212 11/1978 Waterbury ..... 220/346
4,170,724 10/1979 Waterbury ..... 220/346
4,308,979 1/1982 Otterson ..... 220/253

*Primary Examiner*—George T. Hall
*Attorney, Agent, or Firm*—Oltman and Flynn

[57] ABSTRACT

A leakproof disposable container lid is made out of the same plastic material that an ordinary container lid is made of. The present invention adds a simple slot to the lip of the lid. A portion of the outer edge is raised forming a slot. A hole is made in this raised portion. A curved piece of lid material with a matching hole slides through the slot. This inexpensive lid prevents spilling while in transit, especially in moving vehicles. The improvement can increase the popularity of take-out beverage items at fast food restaurants reducing spills inside vehicles and at home.

4 Claims, 7 Drawing Figures

DISPOSABLE LEAKPROOF CONTAINER LIDS

BACKGROUND OF THE INVENTION

The present invention relates to disposable container lids commonly used in take-out fast food restaurants. The primary purpose of the invention is to prevent spillage of the liquid while transporting the container.

Most fast food restaurants dispense their take-out cold drinks in containers having a straw hole in the center. These holes allow liquid to splash out while carrying the container or while transporting it in a car. The liquid squirts out if pressure is put on the lid of a full container. The spillage in a car can cause ugly and unhealthy food stains. Ants and bugs thrive on such stains in pile carpets.

Hot drinks like coffee are usually dispensed in containers having snap-on lids with no holes at all. These lids do a good job of preventing spillage until one is ready to drink. Removal of the entire lid is necessary to drink the contents of the container. This approach can be a disaster in a moving vehicle. First it takes two hands to remove the lid. This is not practical for the driver of a vehicle. Second, an open topped container with a hot liquid inside a moving vehicle presents a danger to the occupants. Severe burns can occur from spills caused by stops and turns. These spills can even contribute to distracting the driver enough to cause an accident.

Several disclosures provide for a reusable heavy duty container lid having a closable slot. These devices provide help from spilling for the professional traveller. They require constant washing to prevent a health hazard. They are not really practical for a family of two adults and four children spontaneously stopping for hamburgers, soft drinks and coffee while returning from shopping, or eating in the car en route to a movie.

The present invention provides a solution for the occassional soda or coffee drinker who drinks in the car. One hand can slide the container lid stopper to the open or closed position. One embodiment is suited to insert a straw for drinking. A second embodiment uses a larger hole in the lid which allows drinking directly from the lid. This invention is constructed from the same material as a conventional, disposable lid. Thus, it offers simplicity and low cost to the container manufacturers selling to fast food take-out restaurants. This invention fills the gap between a simple straw hole and a reusable closable container lid.

SUMMARY OF THE INVENTION

The primary object of the present invention is to provide the fast food take-out restaurants with a low cost means of dispensing liquids in a spillproof container. The low cost means include the use of standard containers. Only the standard container lid is modified to prevent spillage. The lid modification is simple and inexpensive. It consists of adding a raised portion with slots to the lid. The raised portion is adjacent the edge of the lid and has a hole in it suitable either for drinking or as a straw hole. A one-piece insert of the same material as the lid fits into the slots and slidably closes the hole. A matching hole in the sliding member can be aligned with the lid hole thus allowing liquids to pour through. A small flap on the sliding member allows a person to open and close the container lid with one hand. Small notches cut into the sliding member prevent the member from falling off the lid.

Other objects of this invention will appear from the following description and appended claims, reference being had to the accompanying drawings forming a part of this specification wherein like reference characters designate corresponding parts in the several views.

Further objects and advantages of this invention will be apparent from the following detailed description of presently preferred embodiments which illustrated schematically in the accompanying drawings.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DESCRIPTION OF THE PREFERRED EMBODIMENTS

Figure 1:
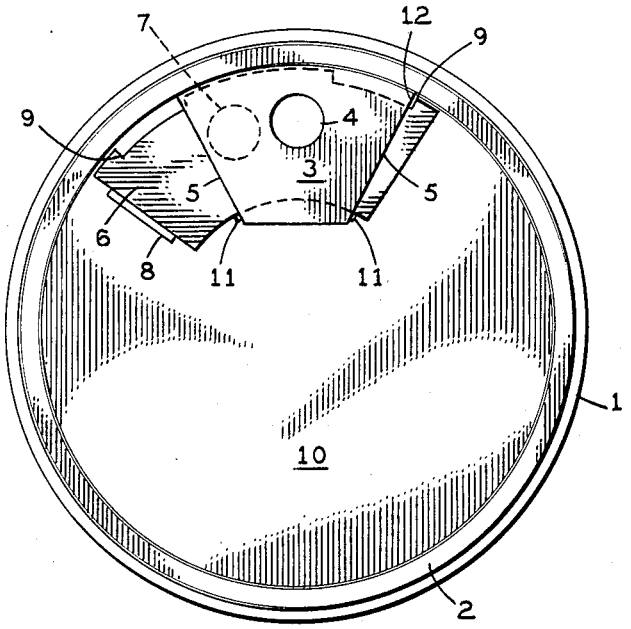
FIG. 1 is a top down plan view of the lid showing the sliding flap in the closed position.

Referring first to FIG. 1, container lid 1 has a lip 2 around the circumference for snapping onto a cooperating container (not shown) in a conventional manner. A portion of the top 10 of the lid has been raised thus forming flap holder 3. Flap holder 3 is raised just high enough to allow closing flap 6 to slide under it. A small ridge 5 extends downward from flap holder 3. Grooves 11 are thus formed between flap holder 3 and top 10. A hole 4 suitable for insertion of a straw is cut into flap holder 3.

Closing flap 6 fits through grooves 12 thus closing hole 4. The material of closing flap 6 can be comprised of, but is not limited to, the same material as lid 1. Closing flaps 6 has a hole 7 matching hole 4. Sliding closing flap 6 until holes 7 and 4 line up opens the container lid. Handle 8 is formed by bending closing flap 6. Handle 8 allows closing flap 6 to be opened and closed by one hand. Tabs 9 prevent the closing flap 6 from being pulled out of flap holder 3 by stopping against the closed tips 12 of grooves 11.

Figure 2:
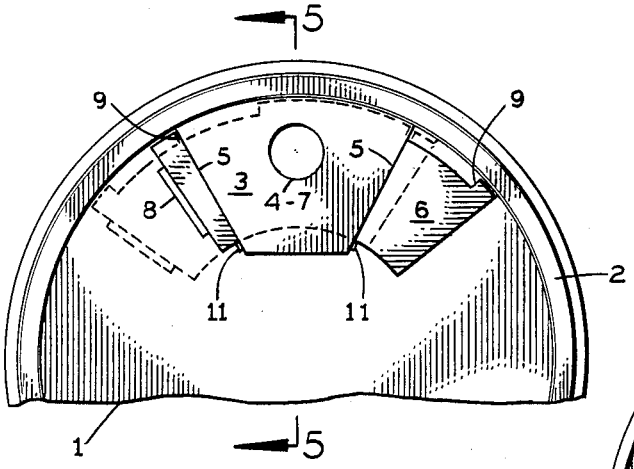
FIG. 2 is a top down fractional view of the same lid as shown in FIG. 1 with the sliding flap in the open position.

FIG. 2 shows lid 1 in the open position. Closing gap 6 has been pulled to align holes 7 and 4. Tabs 9 stop closing flap 6 at the fully open or fully closed positions.

Figure 3:
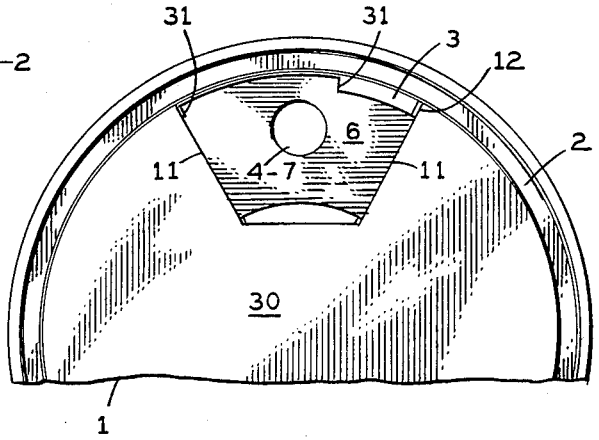
FIG. 3 is a bottom fractional view of the same lid as shown in FIG. 2 in the open position.

FIG. 3 shows the underside 30 of lid 1. Closing flap 6 is in the open position aligning holes 7 and 4. Notches 31 work in cooperation with tabs 9 (see FIGS. 1 and 2) to stop the closing flap 6 at the fully open or closed position by stopping against closed tips 12 of grooves 11.

Figure 4:
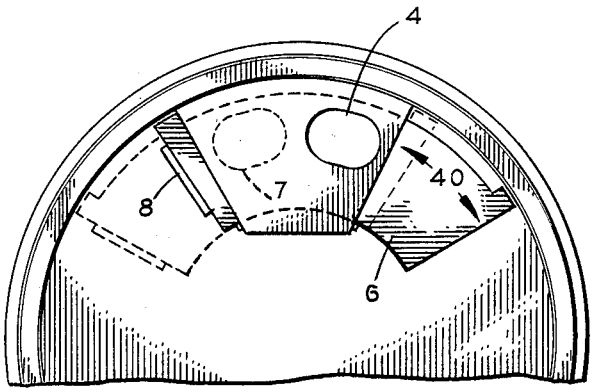
FIG. 4 is a top down fractional view of a lid embodiment suitable for drinking from the container without a straw.

FIG. 4 shows the embodiment suited for drinking directly from the container. Holes 4 and 7 are larger. All other details of this embodiment are substantially similar to FIGS. 1, 2 and 3. For all embodiments the distance of travel of closing flap 6 along line 40 must be at least equal to the diameter of hole 4.

Figure 5:
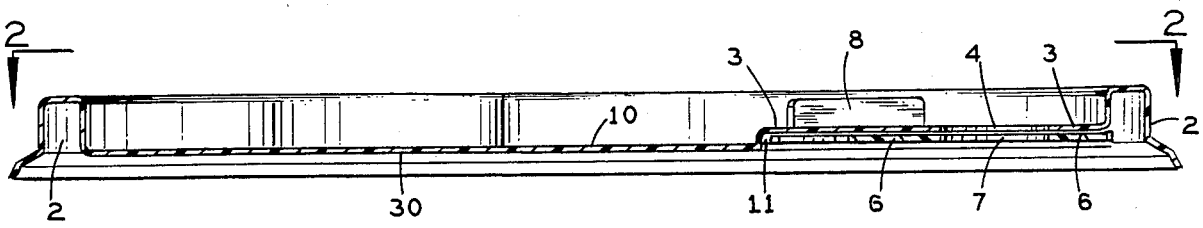
FIG. 5 is a cross-sectional elevational view along line 5 of FIG. 2.

FIG. 5 shows closing flap 6 in the open position under flap holder 3. Closing flap handle 8 projects up above lid top surface 10 enough to allow fingers to grab it and slide closing flap 6 to either the open or closed position.

Figure 6:
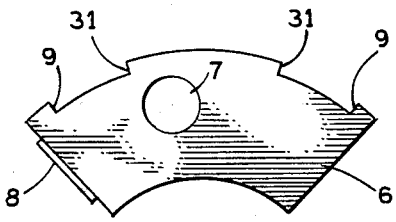
FIG. 6 is a top down detailed view of the sliding flap.

FIG. 6 shows the unique design of closing flap 6. Tabs 9 and notches 31 limit the travel of closing flap 6 to either the open or closed lid position by allowing hole 7 either to align or not align with hole 4 (see FIGS. 1, 2, 3, 4 and 5). Handle 8 is made of a crease and fold in flap 6. Folding flap 6 can be inserted onto lid 1 (see FIGS. 1, 2, 3, 4 and 5) either during manufacturing or in the restaurant by an employee. This design allows the lid 1 with just hole 4 to be manufactured at the same cost as a conventional lid with a hole after the one time retooling is done. This allows the restaurant to use the same lid 1 without closing flap 6 for in-store use which does not require a leakproof lid. Such use can save the cost of needlessly using closing flap 6.

Figure 7:
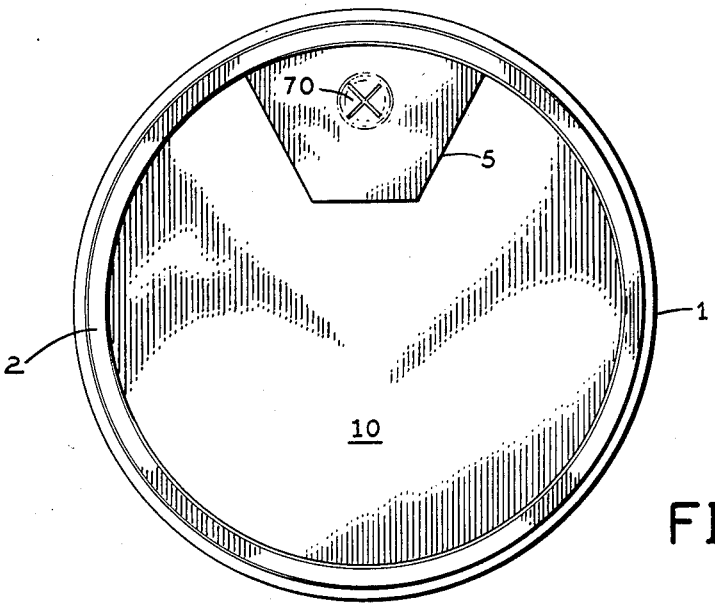
FIG. 7 is a top down view of the lid used without a closing flap.

FIG. 7 shows a lid 1 used without closing flap 6 (see FIGS. 1, 2, 3, 4, 5 and 6). Lid 1 functions to hold a straw (not shown) in the upright position like any conventional lid with a hole. Straw supporting flaps 70 are shown here and could be used on any other embodiment of the present invention suited for straws. Grooves 11 may either be opened or closed during manufacturing. Thus, ridge 5 may be solidly affixed to lid top 10 to prevent spilling through grooves 11 when lid 1 is used without closing flap 6. The restaurant employee can open grooves 11 with a cutting utensil (not shown) and insert closing flap 6 for a leakproof lid (see FIGS. 1, 2, 3, 4, 5 and 6).

I claim:

1. A spillproof drinking container lid comprising a stationary and sliding member wherein:

said stationary member snaps onto a drinking container whereby said container is rendered spillproof;

said stationary member further comprises a raised segment on the upper surface;

said raised segment having slots which function to provide a sliding path for said sliding member beneath;

said raised segment of said stationary member further having a hole;

said sliding member further having a matching hole to that of said stationary member functioning to allow liquid out of said container when said holes are aligned;

said sliding member further comprises notches functioning to align said holes in either the open or closed position and prevent said sliding member from being pulled from said stationary member; and said sliding member further comprising a fold functioning as a handle used to slide said sliding member.

2. The lid of claim 1 wherein said sliding member consists of same material as said stationary member.

3. The lid of claim 1 wherein said sliding member may be readily detached from said stationary member.

4. The lid of claim 1 wherein said stationary member may function as an upright lid without said sliding member.

* * * * *